US008046922B2

(12) United States Patent
Eby et al.

(10) Patent No.: US 8,046,922 B2
(45) Date of Patent: Nov. 1, 2011

(54) CUTTING DEVICE

(75) Inventors: David C. Eby, Madison, WI (US); Christine Dusk, Blanchardville, WI (US); Luc Lam, Chicago, IL (US); Jon Alling, Madison, WI (US)

(73) Assignee: Fiskars Brands, Inc., Madison, WI (US)

( * ) Notice: Subject to any disclaimer, the term of this patent is extended or adjusted under 35 U.S.C. 154(b) by 767 days.

(21) Appl. No.: 12/009,392

(22) Filed: Jan. 18, 2008

(65) Prior Publication Data

US 2009/0183378 A1 Jul. 23, 2009

(51) Int. Cl.
*B26B 3/06* (2006.01)
*B26B 29/02* (2006.01)

(52) U.S. Cl. ..... 30/151; 30/286

(58) Field of Classification Search ..... 30/2, 151, 30/161, 162, 286, 288, 292, 306, 307, 319, 30/329, 340; 606/167; D7/694; D8/98
See application file for complete search history.

(56) References Cited

U.S. PATENT DOCUMENTS

| | | | | | |
|---|---|---|---|---|---|
| 365,714 | A | * | 6/1887 | Warner | 30/286 |
| 1,452,893 | A | * | 4/1923 | Porth | 30/286 |
| 2,209,751 | A | * | 7/1940 | Wulff | 30/2 |
| 2,376,887 | A | * | 5/1945 | Walters | 30/151 |
| 3,532,018 | A | | 10/1970 | Szabo | |
| 3,781,988 | A | * | 1/1974 | Jones | 30/2 |
| 3,973,459 | A | | 8/1976 | Stowe | |
| 4,798,112 | A | | 1/1989 | Kozyrski et al. | |
| 4,980,977 | A | * | 1/1991 | Matin et al. | 30/286 |
| 5,069,097 | A | | 12/1991 | Mori | |
| 5,116,351 | A | * | 5/1992 | Frassetti | 606/167 |
| 5,241,750 | A | * | 9/1993 | Chomiak | 30/2 |
| 5,250,064 | A | * | 10/1993 | Schneider | 606/167 |
| 5,299,355 | A | * | 4/1994 | Boda et al. | 30/162 |
| 5,322,001 | A | | 6/1994 | Boda | |
| 5,478,346 | A | * | 12/1995 | Capewell | 606/167 |
| 5,493,781 | A | * | 2/1996 | Saito | 30/162 |
| 5,522,135 | A | * | 6/1996 | Votolato | 30/2 |
| 5,524,515 | A | | 6/1996 | Boda | |
| 5,676,677 | A | * | 10/1997 | Landis et al. | 606/167 |
| 5,697,157 | A | * | 12/1997 | Votolato | 30/2 |
| 5,802,942 | A | | 9/1998 | Cornell et al. | |
| 5,843,107 | A | * | 12/1998 | Landis et al. | 606/167 |
| 5,852,874 | A | * | 12/1998 | Walker | 30/2 |
| 5,890,290 | A | * | 4/1999 | Davis | 30/2 |
| 5,996,459 | A | | 12/1999 | Cornell et al. | |
| 6,070,326 | A | * | 6/2000 | Berns | 30/2 |
| 6,098,515 | A | | 8/2000 | Daley, Jr. | |

(Continued)

FOREIGN PATENT DOCUMENTS

DE G 8912929.6 * 2/1990

(Continued)

*Primary Examiner* — Jason Daniel Prone
(74) *Attorney, Agent, or Firm* — Foley & Lardner LLP

(57) ABSTRACT

An improved cutting device including a mechanism for selectively guarding the edge of a cutting blade. According to various embodiments, a sliding mechanism is operatively connected to a blade guard, wherein the translational movement of the sliding mechanism causes a corresponding rotational movement of the blade guard. When the blade guard is in an extended position, the edge of the cutting blade is not exposed, thereby preventing a user from accidentally cut by the blade. Various embodiments also provide for an improved blade replacement system. According to various embodiments, a locking member is capable of lifting the cutting blade without the user having to touch the blade itself.

9 Claims, 8 Drawing Sheets

U.S. PATENT DOCUMENTS

| | | | | |
|---|---|---|---|---|
| 6,178,640 | B1 * | 1/2001 | Votolato | 30/2 |
| 6,189,218 | B1 | 2/2001 | Okada | |
| 6,233,832 | B1 * | 5/2001 | Berns | 30/162 |
| 6,327,783 | B1 | 12/2001 | Ming | |
| 6,560,873 | B1 * | 5/2003 | Ortner et al. | 30/2 |
| 6,578,266 | B2 * | 6/2003 | Chomiak | 30/2 |
| 6,643,936 | B2 * | 11/2003 | Carlson et al. | 30/162 |
| 6,718,637 | B1 * | 4/2004 | Ortner et al. | 30/2 |
| 7,082,688 | B2 * | 8/2006 | Votolato | 30/2 |
| 7,111,402 | B1 * | 9/2006 | Pearman | 30/151 |
| 7,204,023 | B2 * | 4/2007 | Chang | 30/162 |
| 7,216,432 | B2 * | 5/2007 | Poteet | 30/340 |
| 7,356,928 | B2 * | 4/2008 | Votolato | 30/2 |
| D582,239 | S | 12/2008 | Eby et al. | |
| 7,475,480 | B2 * | 1/2009 | Votolato | 30/2 |
| 7,509,742 | B2 * | 3/2009 | Votolato | 30/151 |
| 7,533,465 | B1 * | 5/2009 | Frazer | 30/155 |
| 7,726,029 | B2 * | 6/2010 | Votolato | 30/151 |
| 7,810,241 | B2 * | 10/2010 | Pooler | 30/151 |
| 7,886,443 | B2 * | 2/2011 | Votolato | 30/151 |
| 7,966,732 | B2 * | 6/2011 | Votolato et al. | 30/151 |
| 2002/0124412 | A1 * | 9/2002 | Votolato | 30/200 |
| 2004/0093734 | A1 * | 5/2004 | Votolato | 30/2 |
| 2004/0187318 | A1 * | 9/2004 | Mathieu et al. | 30/319 |
| 2005/0086811 | A1 * | 4/2005 | Kawasaki | 30/162 |
| 2005/0188545 | A1 * | 9/2005 | Poteet | 30/340 |
| 2005/0217114 | A1 * | 10/2005 | Votolato | 30/2 |
| 2006/0048389 | A1 * | 3/2006 | Votolato | 30/2 |
| 2006/0236551 | A1 * | 10/2006 | Chang | 30/319 |
| 2006/0248725 | A1 * | 11/2006 | Huang et al. | 30/2 |
| 2007/0022615 | A1 * | 2/2007 | Tsai-Lian | 30/319 |
| 2007/0028461 | A1 * | 2/2007 | Chen Lin | 30/319 |
| 2007/0276422 | A1 * | 11/2007 | Pooler | 606/167 |
| 2008/0010839 | A1 * | 1/2008 | Eby et al. | 30/319 |
| 2008/0201960 | A1 * | 8/2008 | Watanabe | 30/151 |
| 2009/0172889 | A1 * | 7/2009 | Votolato | 30/337 |
| 2009/0271988 | A1 * | 11/2009 | Votolato | 30/161 |
| 2010/0037787 | A1 * | 2/2010 | Eide et al. | 30/319 |
| 2010/0236076 | A1 * | 9/2010 | Votolato et al. | 30/151 |

FOREIGN PATENT DOCUMENTS

| | | | |
|---|---|---|---|
| DE | 20 2006 013 605 | U1 | 1/2007 |
| EP | 0 126 641 | A | 11/1984 |
| EP | 1422031 | A1 * | 5/2004 |
| GB | 2 320 453 | A | 6/1998 |
| WO | WO 2008008237 | A1 * | 1/2008 |

* cited by examiner

CUTTING DEVICE

FIELD OF THE INVENTION

The present invention relates generally to cutting devices. More particularly, the present invention relates to rotary cutting devices used to cut various types of materials.

BACKGROUND OF THE INVENTION

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Handheld rotary cutters are commonly used to cut layers of fabric, cardboard, paper, vellum or other materials. Rotary cutters typically include a body with a handle attached thereto for gripping by a user. A generally circular head includes a surface to which a substantially circular cutting blade is attached.

Although a variety of conventional handheld rotary cutters are available, many such cutters possess a number of drawbacks. For example, in order to remove and/or attach a cutting blade to the cutter, a user must often directly touch a portion of the cutting blade. This is undesirable since it poses a safety hazard. Additionally, because it is often desirable in some rotary cutters to "store" the cutting blade when not in use (i.e., so that a user is not accidentally injured by the blade when the device is being transported, for example), a mechanism is needed to easily and securely move the blade from an "in use" position to a "storage" position and vice versa. However, such mechanisms can also result in the blade moving to a small extent during use, since the mechanism to which the blade is operatively connected inherently may have a certain amount of "give" or looseness. This can result in the rotary cutter operating at a less than desirable level.

SUMMARY OF THE INVENTION

Various embodiments provide an improved cutting device including a mechanism for selectively guarding the edge of a cutting blade. According to various embodiments, a sliding mechanism is operatively connected to a blade guard, wherein the translational movement of the sliding mechanism causes a corresponding rotational movement of the blade guard. When the blade guard is in an extended position, the edge of the cutting blade is not exposed, thereby preventing a user from being accidentally cut by the blade.

Various embodiments also provide for an improved blade replacement system. According to various embodiments, a locking member is capable of lifting the cutting blade without the user having to touch the blade itself. When the user wishes to replace the blade, the locking member is used to remove the old blade from the rotary cutter and place the old blade in a used blade storage region. The locking member may then be used to lift a new blade from a new blade storage region and correctly position the new blade on the rotary cutter.

These and other advantages and features of the invention, together with the organization and manner of operation thereof, will become apparent from the following detailed description when taken in conjunction with the accompanying drawings, wherein like elements have like numerals throughout the several drawings described below.

DETAILED DESCRIPTION OF VARIOUS EMBODIMENTS

Figure 8:
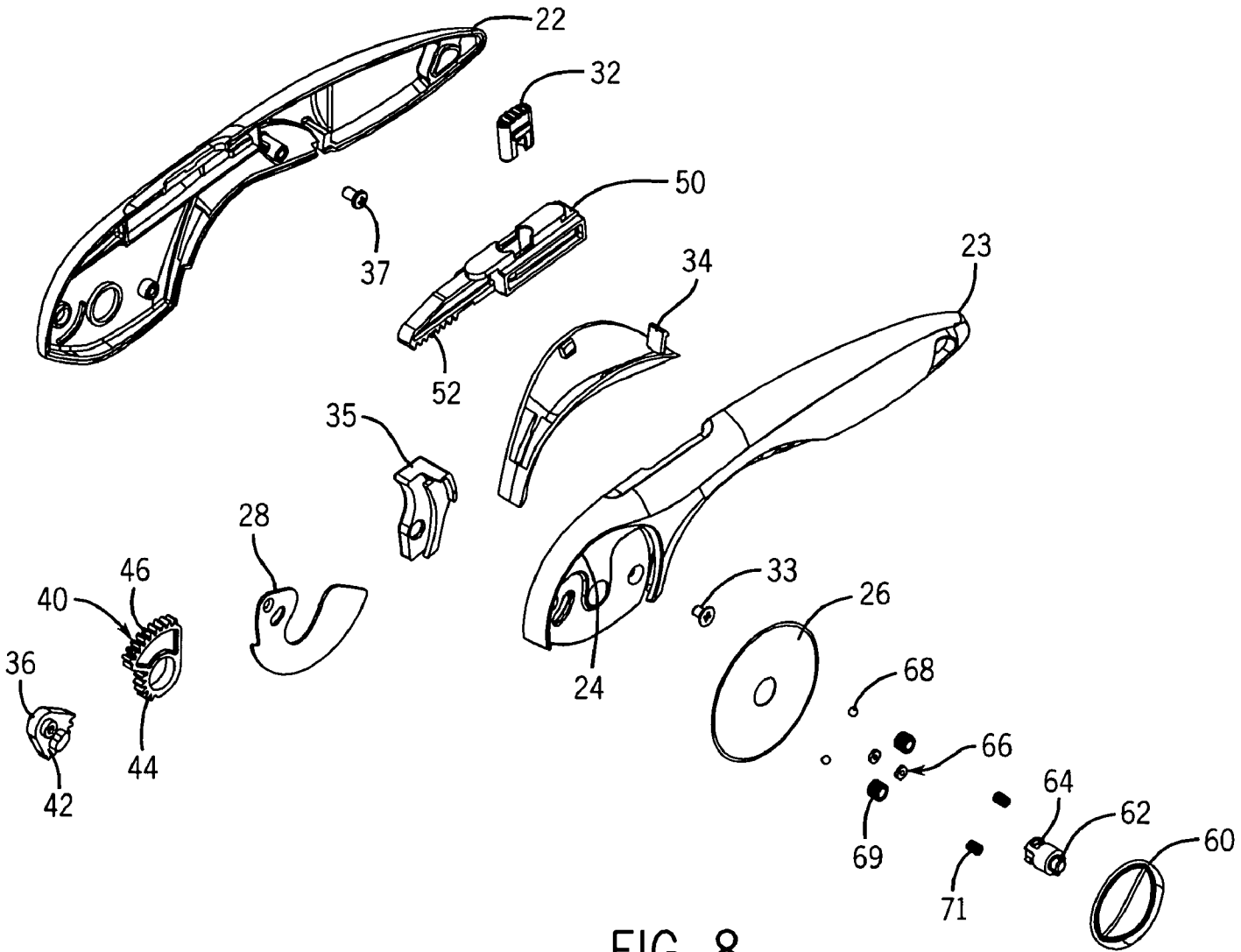
FIG. 8 is an exploded view showing the individual components of the rotary cutter of FIG. 1.
Figure 9:
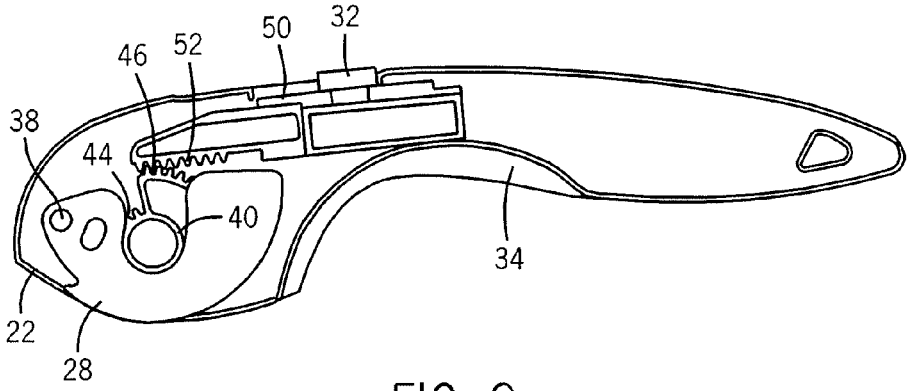
FIG. 9 is a left sectional side view of the rotary cutter of FIG. 1, when the rotary cutter guard is in a retracted position and the cutting blade is removed.
Figure 10:
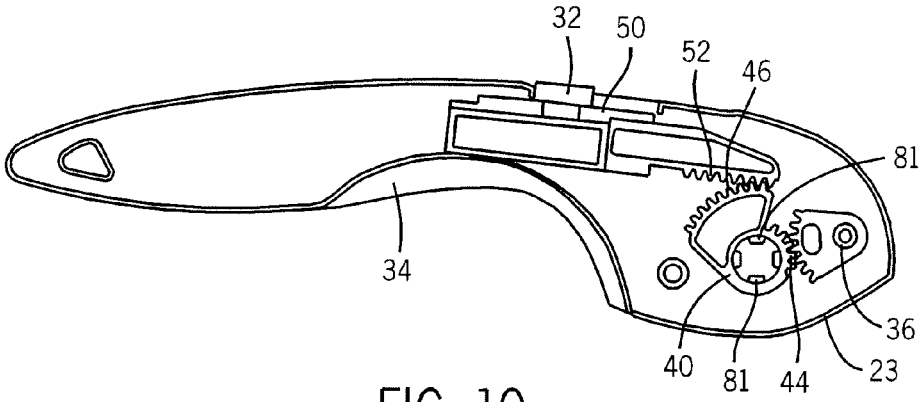
FIG. 10 is a right sectional side view of the rotary cutter of FIG. 1, when the rotary cutter guard is in a retracted position and the cutting blade is removed.
Figure 11:
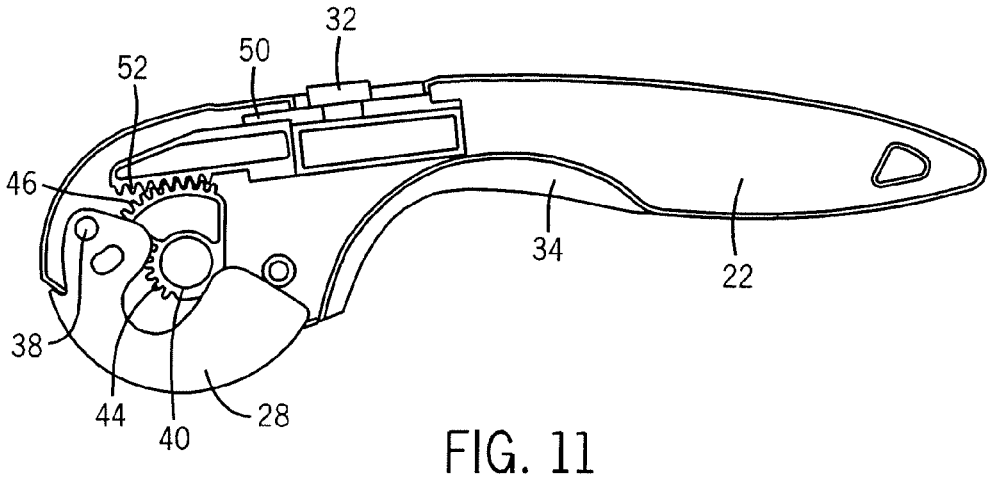
FIG. 11 is a left sectional side view of the rotary cutter of FIG. 1, when the rotary cutter guard is in a extended position and the cutting blade is removed.
Figure 12:
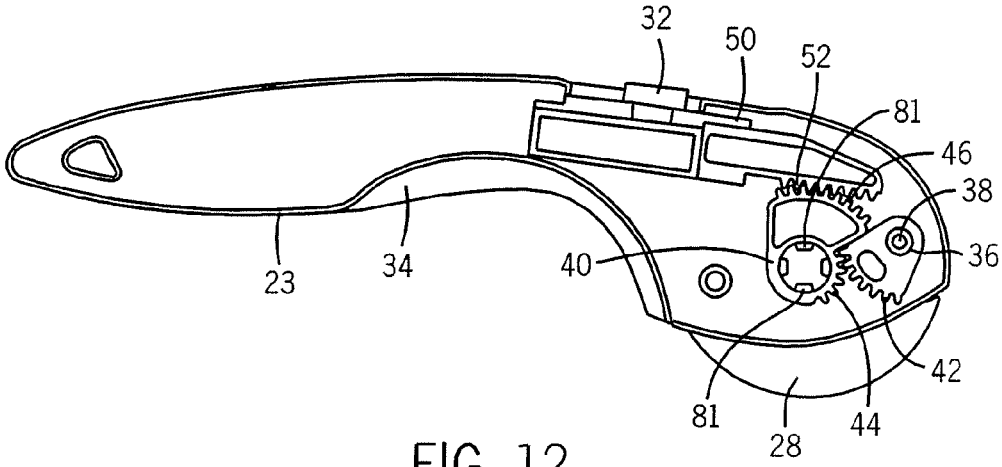
FIG. 12 is a right sectional side view of the rotary cutter of FIG. 1, when the rotary cutter guard is in a extended position and the cutting blade is removed.

FIGS. 1-7 show a hand-held rotary cutter 20 according to one particular embodiment of the present invention. As shown in FIGS. 1-7, the rotary cutter 20 includes a first housing portion 22 operatively connected to a second housing portion 23. As shown in FIG. 8, for example, the first and second housing portions 22 and 23 may be operatively connected to each other by a housing securement member 33 that passes through a baffle 35. An additional fastener 37 may also be used to secure the first and second housing portions 22 and 23 to each other.

The second housing portion 23 includes a blade acceptance region 24 for accepting a cutting blade 26 and a blade guard 28. As discussed below, the blade guard 28 is selectively positionable so as to prevent the user from being accidentally being cut by the cutting blade 26 when the rotary cutter is not in use. The selective positioning of the blade guard 28 is accomplished using a trigger mechanism, in the form of a slide member 32 in the embodiments of FIGS. 1-12, that is accessible by a user. A blade securement mechanism 30 is used to selectively secure the cutting blade 26 to the rotary cutter 20. As discussed below, the blade securement mechanism 30 may also be used to selectively remove and insert cutting blades 26 as needed in particular embodiments. The rotary cutter 20 may include a grip portion 34 in order to provide added comfort to the user. As shown in greater detail in FIG. 8, the grip portion 34 may partially extend inside the rotary cutter 20 so that the grip portion is properly secured.

FIGS. 8-12 show the individual components of the rotary cutter 20 in greater detail, along with the interactions among these various components. In the embodiment shown in FIGS. 8-12, the slide member 32 engages a slide base 50, which is capable of translational movement along a major axis of the rotary cutter 20. In an alternate embodiment, the slide base 50 and the slide member 32 can be formed of a single piece. The slide base 50 engages a pinion gear 40 in a rack-and-pinion arrangement, with slide teeth 52 on the slide base 50 engaging a plurality of first pinion gear teeth 46 on the pinion gear 40. The translational movement of the slide base 50 results in a rotational movement of the pinion gear 40.

In addition to the plurality of first pinion gear teeth 46, the pinion gear 40 also includes a plurality of second pinion gear teeth 44. When the pinion gear 40 rotates, the second pinion gear teeth 44 drive a guard gear 36. More particularly, the guard gear 36 includes guard gear teeth 42, which rotationally engage the second pinion gear teeth 44. As a result of this interaction, the guard gear 36 is capable of rotating, albeit in a direction substantially opposite to the direction of rotation of the pinion gear 40. The blade guard 28 is coupled to the guard gear 36 via a guard gear securement member 38 (a screw in one particular embodiment). As a result of the engagement between the blade guard 28 and the guard gear 36, any rotation of the guard gear 36 causes a corresponding rotation of the blade guard 28 about the guard gear securement member 38.

Figure 1:
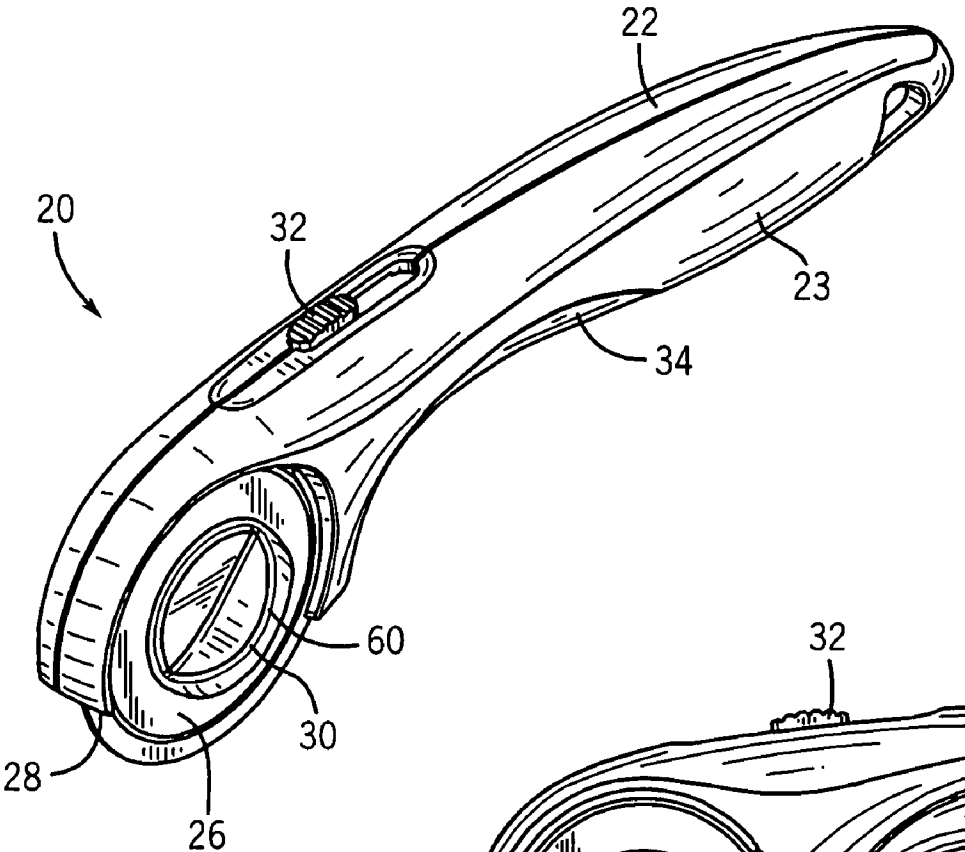
FIG. 1 is a perspective view of a rotary cutter according to one exemplary embodiment of the present invention.
Figure 2:
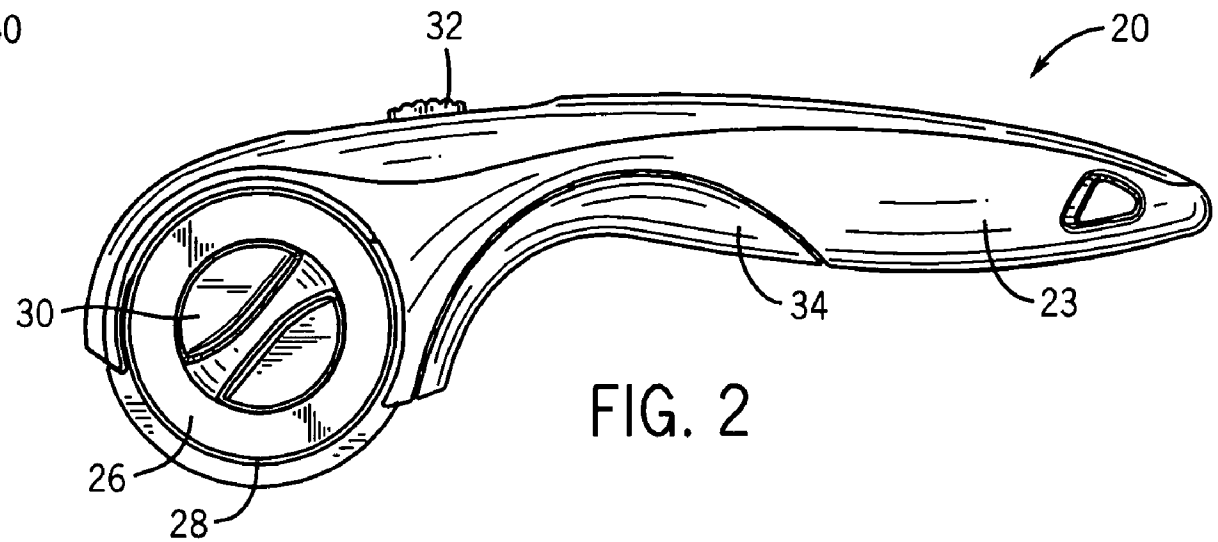
FIG. 2 is a left side view of the rotary cutter of FIG. 1.
Figure 3:
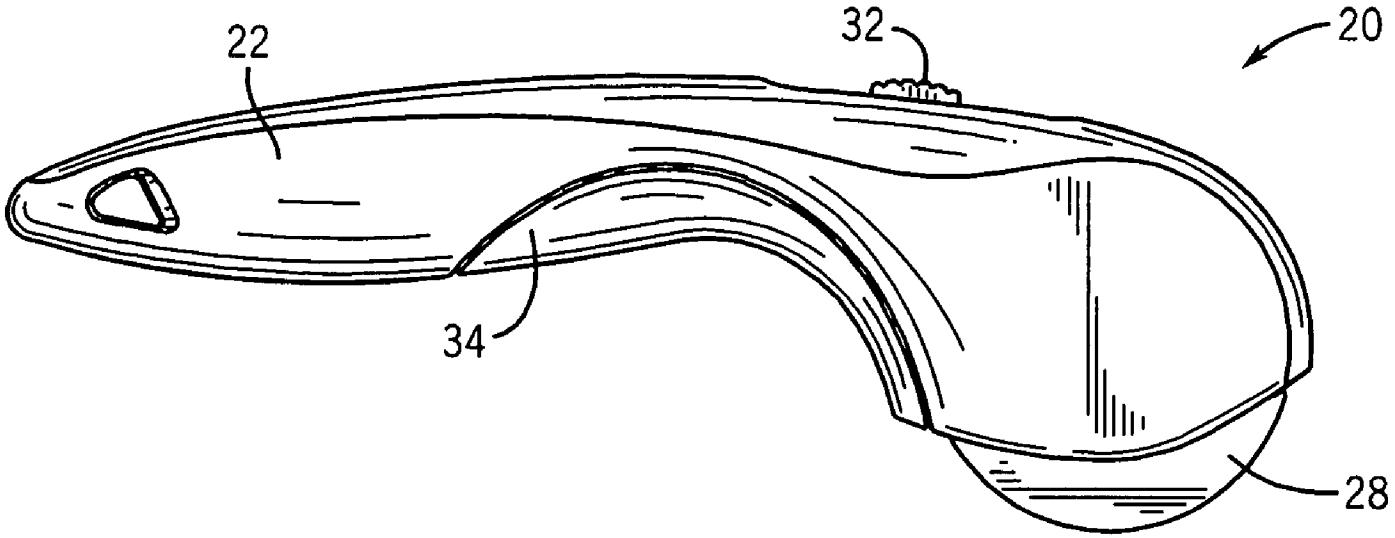
FIG. 3 is a right side view of the rotary cutter of FIG. 1.
Figure 4:
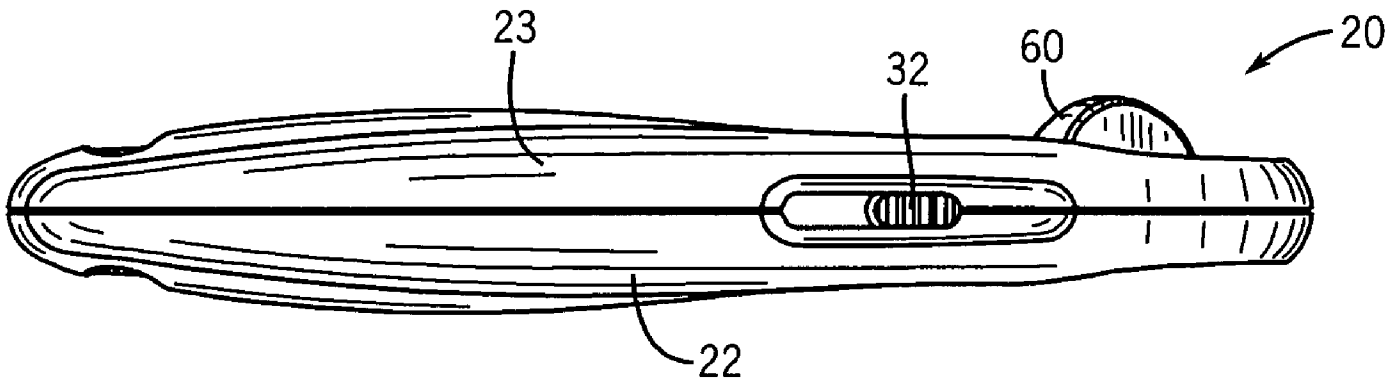
FIG. 4 is a top view of the rotary cutter of FIG. 1.
Figure 5:
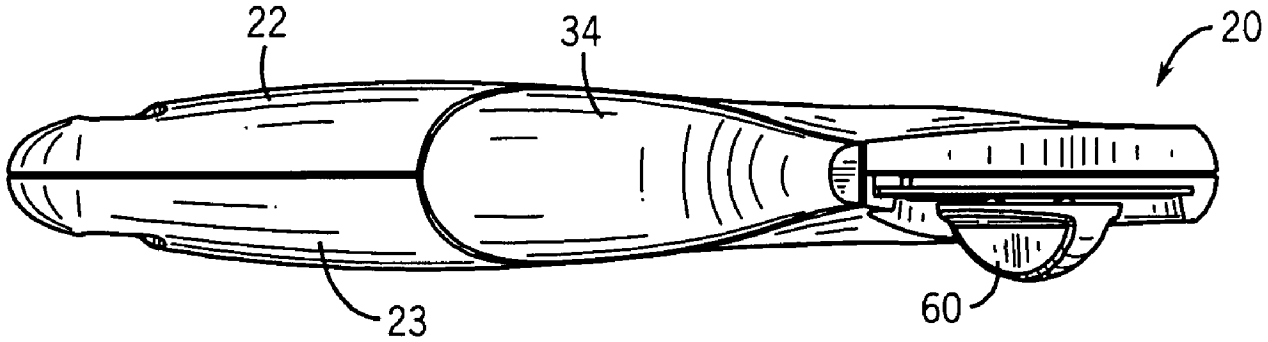
FIG. 5 is a bottom view of the rotary cutter of FIG. 1.
Figure 7:
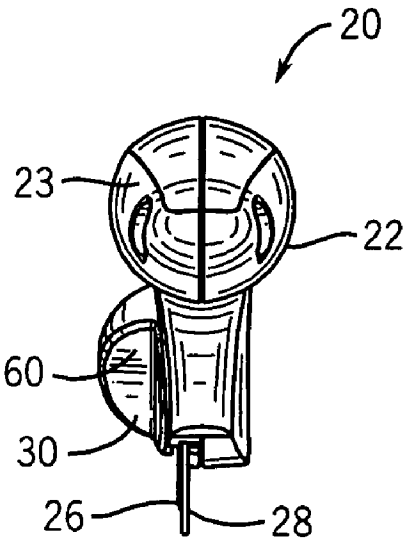
FIG. 7 is a rear view of the rotary cutter of FIG. 1.
Figure 6:
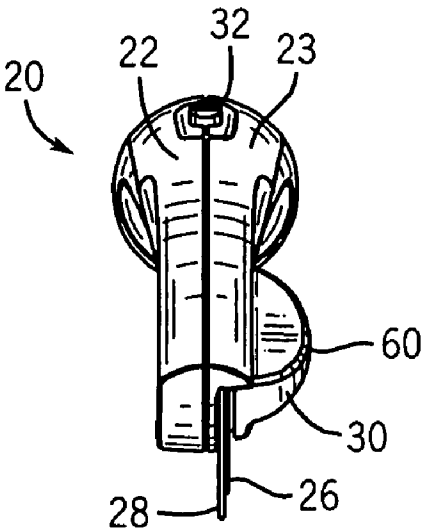
FIG. 6 is a front view of the rotary cutter of FIG. 1.

The above interaction among the blade guard 28, the guard gear 36, the pinion gear 40 and the slide base 50 permits the blade guard 28 to rotate between a retracted position and an extended position. As shown in FIGS. 1 and 2, for example, when the blade guard 28 is in the extended position, the an edge of the blade guard 28 extends beyond an edge of the cutting blade 26, which itself is not capable of retracting or extending in various embodiments. As a result, the edge of the cutting blade 26 is not exposed when the blade guard 28 is in the extended position, thereby preventing a user from accidentally cutting himself or herself when the blade guard 28 is extended. In the embodiment shown in FIGS. 1-12, the slide base 50 is only capable of translational movement when the slide member 32 is depressed. This can provide an added amount of safety to the user when the blade guard 28 is extended, since the user must affirmatively push the slide member 32 downward in order for the blade guard 28 to even be capable of being retracted.

As shown in FIG. 8, the blade securement mechanism 30 may comprise a handle 60 and a post 62, with a portion of the post 62 securely engaged within the handle 60. In an alternative embodiment, the post 62 separate from the blade securement mechanism 30. In this embodiment, the post 62 is securely engaged with a portion of the body of the rotary cutter 20 and is separate but removably engageable with the handle 60. The post 62 is also sized such that the cutting blade 26 can be placed around the post 62.

In the embodiment shown in FIG. 8, the post 62 includes a plurality of channels 64 which are sized and positioned to selectively engage a plurality of acceptance portions 81 (best shown at 81 in FIGS. 10 and 12) on the second housing portion 23, thereby locking the blade securement mechanism 30 in place. More particularly, depending upon the respective rotational position of the post 62, the plurality of channels 64 may be either engaged or disengaged with the acceptance portions 81. When the plurality of channels 64 are disengaged from the acceptance portions 81, the blade securement mechanism 30 may be removed from and reconnected with the rest of the rotary cutter 20 as necessary or desired. It should be understood that, although FIG. 8 shows the use of channels 64, other types of structure may be used so that the blade securement mechanism 30 can engage the rest of the rotary cutter 20.

In addition to the handle 60 and the post 62, the blade securement mechanism 30 may include one or more magnetic portions 66. In the embodiment depicted in FIGS. 1-12, a pair of magnetic portions 66 are at least partially embedded into the handle 60. In an alternative embodiment, the some or all of the post 62 and/or the handle 60 may be magnetic. The number and arrangement of magnetic portions 66 may vary. The magnetic portions 66 are configured to attract the metal used in many conventional cutting blades 26. As a result, a user is capable of lifting the entire securement member 30 without directly contacting the cutting blade 26, and there is little risk of the cutting member 26 accidentally falling off of the post 62. The blade securement mechanism 30 may also include one or more of bearings 68 housed in casings 69, with the bearings 68 being used to aid in the rotation of the cutting blade 26 about the post 62. One or more biasing members 71, in the form of compression springs in various embodiments, may also be used to bias the cutting blade 26 away from the surface of the blade securement mechanism 30 to a desired extent, thereby permitting the cutting blade to more freely rotate as needed or desired. The biasing members 71 serve to maintain the blade securement mechanism 30 at a set distance from the rotary cutter in order to maintain the correct locking position for the acceptance portions 81 within the channels 64 of the post 62.

Figure 13:
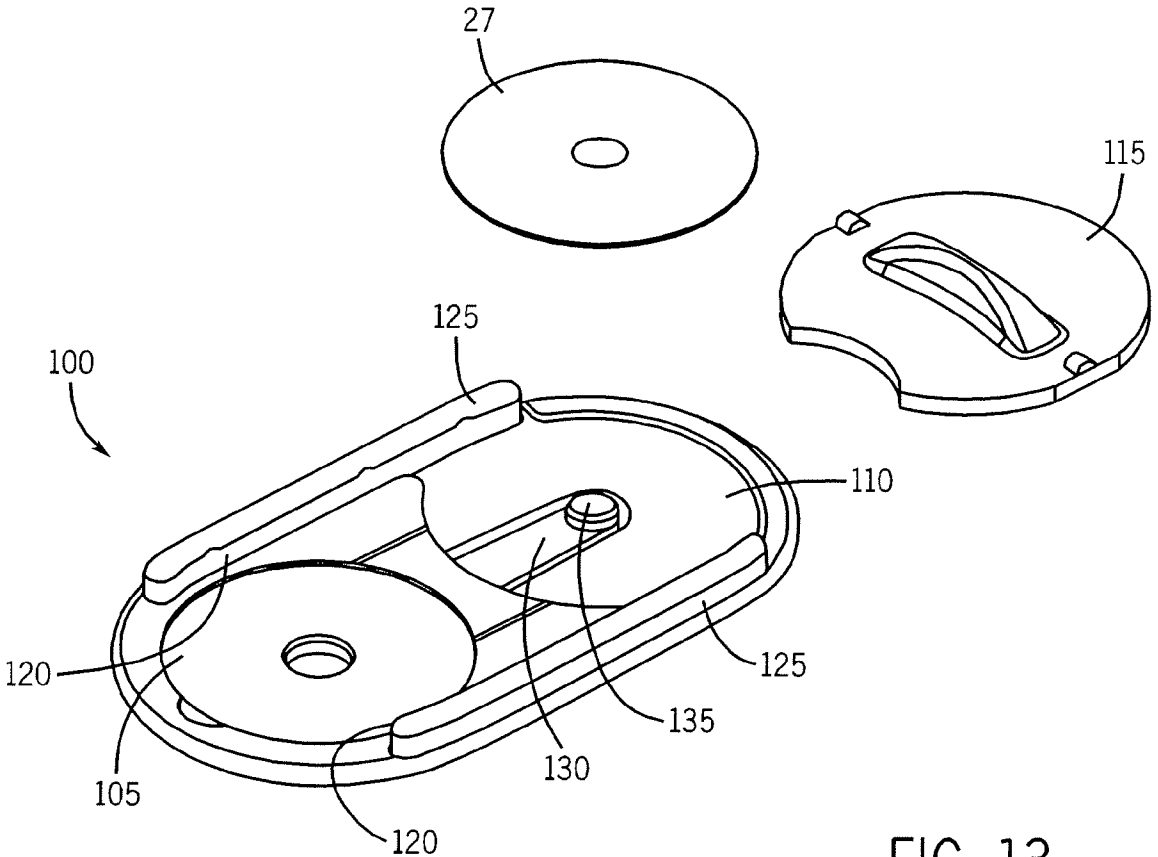
FIG. 13 is a perspective disassembled view of an exemplary blade replacement system for use with the rotary cutter of FIG. 1.
Figure 14:
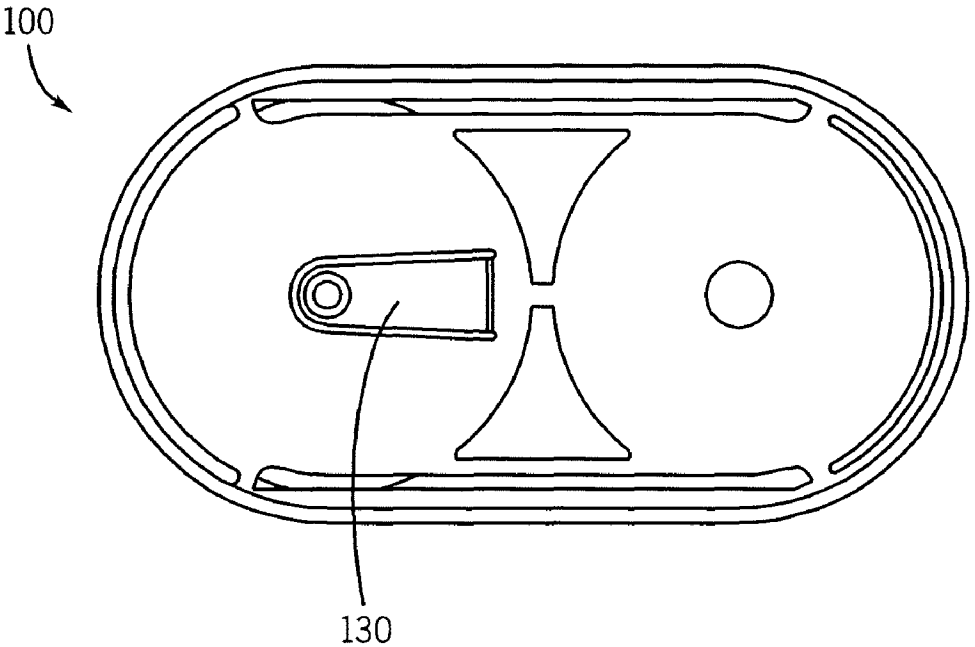
FIG. 14 is a bottom view of the blade replacement system of FIG. 13 when assembled.

FIGS. 13 and 14 show a blade replacement mechanism 100 for use in various embodiments of the present invention. The blade replacement mechanism 100 provides a simple structure that permits a user to replace cutting blades 26 without ever having to touch a blade. The blade replacement mechanism includes an old blade storage region 105 and a new blade storage region 110, both of which are sized to accept the cutting blade 26 to be used by the rotary cutter 20. In addition, a cover portion 115 is movable so as to selectively cover the old blade storage region 105 or the new blade storage region 110 as desired. In one particular embodiment, the cover portion is slidable in channels 120 defined in sidewalls 125 of the blade replacement mechanism 100. The new blade storage region 110 of the blade replacement mechanism 100 includes a tab 130 with a predetermined degree of flexibility. The tab 130 includes a projection 135 sized to receive the center portion of the cutting blade 26. In one embodiment, all components of the blade replacement mechanism 100 are formed from a plastic material, although other types of material may also be used.

The operation of the blade replacement mechanism 100 is generally as follows. When a user desires to replace a cutting blade 26, he or she uses the blade securement mechanism 30 to remove the cutting blade 26 from the rotary cutter 20. Due to the presence of the magnetic portions 66, the cutting blade 26 remains securely positioned on the post 62 during this process. The blade replacement process begins with the cover portion 115 positioned over the new blade storage region 110, with the cover portion 115 protecting a new cutting blade 27. The user places the blade securement mechanism 30/(old) cutting blade 26 combination into the old blade storage region 105. The user then moves the cover portion 115 until it contacts the blade securement mechanism 30. At this point, the cover portion 115 partially covers the cutting blade 26 within the old blade storage region 105. The user then lifts the blade securement mechanism 30. Because the cover portion 115 partially covers the old cutting blade 26, the cutting blade 26 is disassociated from the blade securement mechanism 30.

Once the old cutting blade 26 is completely disassociated from the blade securement mechanism 30, the user moves the cover portion 115 so that it does not cover any portion of the new blade storage region 110 (with the new cutting blade 27 located thereon). The user then positions the blade securement mechanism 30 such that the post 62 aligns with the projection 135 and then imposes a force against the blade securement mechanism 30. This force causes the tab 130 to flex in a generally downward direction to an extent sufficient to permit the side of the handle 60 including the magnetic portions 66 will contact the new cutting blade 27. The magnetic force imparted by the magnetic portions 66 causes the blade securement mechanism 30 to "grab" the new cutting blade 27, making it possible to remove the new cutting blade 27 without the user physically touching it. The user can then reengage the blade securement mechanism 30/new cutting blade 27 combination with the rest of the rotary cutter 20.

In an alternative embodiment of the invention, the blade replacement mechanism 100 may include one or more magnetic elements (not shown) thereon, with the magnetic elements being used to attract the cutting blade 26 and/or the new cutting blade 27 during blade replacement. In a particular embodiment, the magnetic elements on the blade replacement mechanism 100 may be used instead of the magnetic portions 66 on the blade securement mechanism 30.

The foregoing description of embodiments of the present invention have been presented for purposes of illustration and description. The foregoing description is not intended to be exhaustive or to limit embodiments of the present invention to the precise form disclosed, and modifications and variations are possible in light of the above teachings or may be acquired from practice of various embodiments of the present invention. The embodiments discussed herein were chosen and described in order to explain the principles and the nature of various embodiments of the present invention and its practical application to enable one skilled in the art to utilize the present invention in various embodiments and with various modifications as are suited to the particular use contemplated.

What is claimed is:

1. A handheld cutting device, comprising:

a body having a rear end and a forward end, the body further including a blade guard securement member;

a cutting blade operatively connected to the body;

a blade guard operatively connected to the blade guard securement member and pivotally movable in a plane substantially parallel to a major plane of the cutting blade axis between a retracted position and an extended position where the blade guard is positioned to selectively guard an edge of the cutting blade; and a trigger mechanism operatively connected to the blade guard securement member and being selectively actuable by a user, the selective actuation of the trigger mechanism causing the blade guard to pivot between the retracted position and the extended position, the trigger mechanism comprising:

a slide base;

a pinion gear rotatably engaging the slide base; and a guard gear rotatably engaging the pinion gear, the guard gear coupled to the blade guard securement member, wherein a rotation of the guard gear causes a corresponding rotation in the blade guard, wherein the edge of the cutting blade is exposed for cutting when the blade guard is in the retracted position, and wherein the edge of the cutting blade is not exposed for cutting when the blade guard is in the extended position.

2. The handheld cutting device of claim 1, wherein translational movement of the slide base towards the forward end of the body causes the blade guard to move towards the extended position, and wherein translational movement of the slide base towards the rear end of the body causes the blade guard to move towards the retracted position.

3. The handheld cutting device of claim 1, further comprising a blade securement mechanism removably coupled to the body, the blade securement mechanism including:

a handle; and a post operatively connected to the handle, the post sized to accept the cutting blade thereon and configured to selectively engage the body, wherein engagement of the post with the body secures the cutting blade to the body.

4. The handheld cutting device of claim 3, wherein at least a portion of the blade securement mechanism is magnetic so as to attract the cutting blade.

5. The handheld cutting device of claim 1, further comprising:

a post operatively connected to the body and sized to accept a cutting blade thereon; and a blade securement mechanism removably connected to the post, the blade securement mechanism including an acceptance region for accepting the post.

6. A handheld cutting device, comprising:

a body;

a replaceable cutting blade operatively connected to the body;

a blade guard connected to the body and pivotally movable in a plane substantially parallel to a major plane of the cutting blade between a retracted position and an extended position; and a trigger mechanism operatively connected to the blade guard, the trigger mechanism configured to selectively move the blade guard between a retracted position and an extended position, the trigger mechanism comprising a gearing system including a slide base and a guard gear, wherein a translational movement of the slide base causes a corresponding rotational movement in the guard gear, wherein the edge of the cutting blade is exposed for cutting when the blade guard is in the retracted position, and wherein the edge of the cutting blade is not exposed for cutting when the blade guard is in the extended position.

7. The handheld cutting device of claim 6, wherein translational movement of the slide base towards a forward end of the body causes the blade guard to move towards the extended position, and wherein translational movement of the slide base towards a rear end of the body causes the blade guard to move towards the retracted position.

8. The handheld cutting device of claim 6, further comprising:

a plurality of acceptance portions disposed on the body; and a blade securement mechanism removably coupled to the body, the blade securement mechanism sized to accept the cutting blade and including a plurality of channels configured to selectively engage the plurality of acceptance portions, wherein engagement of the plurality of channels with the plurality of acceptance portions secures the cutting blade to the body.

9. The handheld cutting device of claim 8, wherein at least a portion of the blade securement mechanism is magnetic so as to attract the cutting blade.

* * * * *